United States Patent [19]

Eigenmann

[11] 4,288,487

[45] Sep. 8, 1981

[54] METHOD OF FORMING SURFACE MARKINGS ON ROADWAY AREAS, AND ROADWAY AREAS PRODUCED THEREBY

[76] Inventor: Ludwig Eigenmann, POB 8, CH 6833, Vacallo, Switzerland

[21] Appl. No.: 23,087

[22] Filed: Mar. 22, 1979

[30] Foreign Application Priority Data

Apr. 7, 1978 [IT] Italy ..... 22101 A/78

[51] Int. Cl.[3] ..... B32B 5/16; E01F 9/04

[52] U.S. Cl. ..... 428/213; 404/9; 427/137; 427/180; 427/202; 428/323; 428/325; 428/332; 428/913

[58] Field of Search ..... 428/323, 325, 913, 220, 428/213; 350/105; 404/14, 17, 18, 12, 9; 427/202, 137, 180

[56] References Cited

U.S. PATENT DOCUMENTS 3,879,148 4/1975 Eigenmann ..... 350/105
3,900,605 8/1975 Norris, Jr. ..... 427/137
3,989,775 11/1976 Jack et al. ..... 350/105
4,069,787 1/1978 Wyckoff ..... 427/137
4,072,403 2/1978 Eigenmann ..... 350/105

*Primary Examiner*—Paul J. Thibodeau
*Attorney, Agent, or Firm*—Michael J. Striker

[57] ABSTRACT

A pressure regulating marking on a roadway area is formed by applying onto a surface area a traffic-wear resistant layer having a small thickness and constituted by a pigmented resin material, providing a plurality of retroreflective globules having a minimum dimension which is many times greater than the thickness of the traffic-wear resistant layer, wetting the globules by a wetting resin material which is compatible with the pigmented resin material of the traffic-wear resistant material, and applying the globules which are wetted by the wetting resin material, onto the traffic-wear resistant layer, so that the wetting resin material forms, in the region of each of the globules a collar which firmly connects each globule to the traffic-wear resistant layer.

16 Claims, 3 Drawing Figures

Rg
Rg
Wr+MK
Nw
Pl
Rp
S

Rg
Wr
Rg
Wra
S
Wr+MK
Wrs
Rg
III
Pl
Rp
Nw

Rg
Lb
Wra
Wra
Nw
Wrs
S
Msp
Pl
Rp

METHOD OF FORMING SURFACE MARKINGS ON ROADWAY AREAS, AND ROADWAY AREAS PRODUCED THEREBY

BACKGROUND OF THE INVENTION a. The Field of the Invention

This invention is concerned with forming highly efficient markings on the surface of roadway areas to provide such areas with traffic regulating signs, such as traffic lane dividing lines, parking areas defining lines, pedestrian crossing signalling strips and so on.

This invention also relates to roadway areas provided with such markings.

b. The Prior Art

Markings and methods of their formation are well known. A number of patents strictly related this art have been heretofore issued. The problems involved in this art have been extensively discussed in my U.S. Pat. Nos. 4,069,281, and 4,146,635.

In the first Patent there has been described and claimed a method of forming nighttime visible markings on a roadway and in general, a roadway area pavement, this method comprising the steps of providing a lower base-forming layer to be subsequently applied to a roadway surface, applying a hardenable synthetic plastic material over said lower layer to form thereon an upper layer of such synthetic plastic material, embedding anti-skid particles in said upper layer prior to hardening of said synthetic plastic material, applying additional quantities of synthetic plastic material onto said upper layer at longitudinally spaced locations of the same and prior to hardening of the material thereof, so that each such additional quantity forms a protuberance on said upper layer, and cascading light-reflective particles over said protuberances prior to hardening of the synthetic plastic material thereof, so that upon subsequent hardening said reflective particles adhere to said protuberances.

There has been also described that the retro-reflective or retro-collimating particles or elements comprise a suitably reflectorised transparent body, that the upper layer is a traffic wear resisting layer consisting essentially of a high cohesion resin preferably selected from the group comprising polyurethane resin, polyamide resin and polyester resin, compatible with the said base and upper layer.

There has been further described and illustrated that the said retro-reflective (or retro-collimating) elements, appertaining to prior art, comprise globules the dimensions of which are largely greater than the thickness of the traffic wear resisting upper layer (U.S. Pat. No. 4,069,281, FIG. 11), which consists of a pigmented resin because the strip or another sign has the visibility as its primary object and therefore the sign must be sharply apparent on the roadway area pavement.

In the second patent there has been described and a marking comprising an impregnated, saturable layer permeated with a flexible tension resistant polymeric resin, which is partially impregnated by the composition of a primer layer and by the composition of the wear resistance upper layer. There has been further described a marking comprising a pigmented wear resistant composition which is substantially the same as the intermediate layer impregnating composition and an exceptionally thin pigmented wear resistant upper layer originated by the impregnation resin.

The most of the problems involved in the above described art can be assumed as having been satisfyingly solved. Certain problems are not completely solved namely problems related with costs and with some heretofore not technically superable limitation of the production rate, namely of the tape material of which the signs are to formed.

OBJECTS AND SUMMARY OF THE INVENTION

Therefore one object of the present invention is to provide an advantageous and further improved method of forming surface markings on roadway areas, wherein a wear resistant pigmented resin layer must not have a thickness proportional to the dimension of the retro-reflective elements.

Another object of the present invention is to provide a highly efficiently signalled roadway area, namely a roadway pavement corresponding to the best optical efficiency and cost relationship.

In keeping with these objects and others, the new method comprises the steps including forming a traffic wear resisting layer having a very small thickness and consisting of a pigmented resin, and applying to said layer retro-reflective globules the minimal dimension of which is many times greater than the thickness of the layer and preliminarily wetted by a resin compatible with said segmented resin, the degree of wetting being such than when the wetted globules contact the still unhardened layer a base forming resinous collar consisting of a wetting resin compatible with the pigmented resin is provided, the collar connecting the globule with the layer and possessing resistance to the most severe traffic abuse upon hardening of the pigmented resin of this layer.

Preferably the wetting resin compatible with said pigmented resin is identical to the same latter and is differentiated therefrom by a higher degree of catalyzation.

Another advantageous feature of the present invention is that the traffic wear resistant layer has a thickness which not greater than half millimeter.

Still a further advantageous feature is that the globules are of minimal dimension greater than one millimeter, and preferably asymmetrical in a vertical sectional plane and elongated in the direction of light impingement.

These and other features and advantages of the invention will be made best apparent from the following detailed description of a preferred embodiment of same invention, reference being made to the accompanying drawing.

THE VIEWS OF THE DRAWING

DETAILED DESCRIPTION OF THE PREFERRED EMBODIMENT

Figure 1:
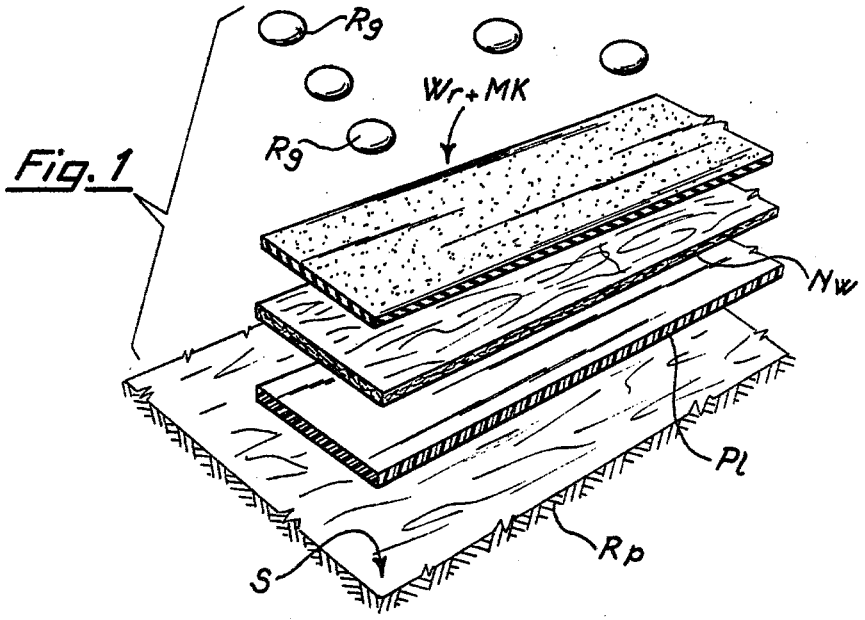
FIG. 1 is a diagrammatical perspective view of the components to be associated for carrying out the method of the invention.
Figure 2:
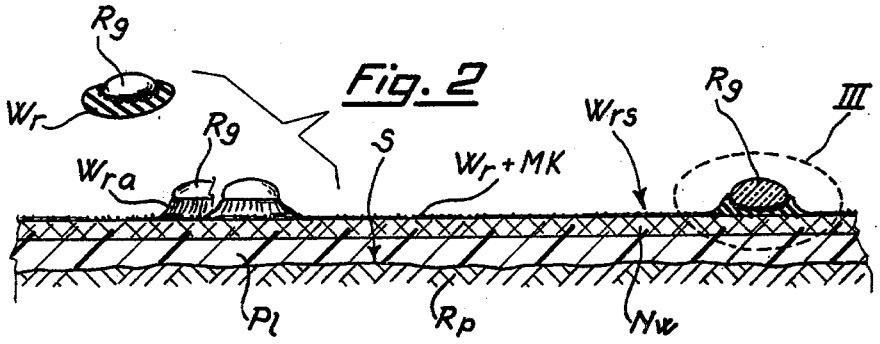
FIG. 2 is a fragmentary diagrammatical sectional view of the sign produced according to the invention, the view being taken in a vertical plane.
Figure 3:
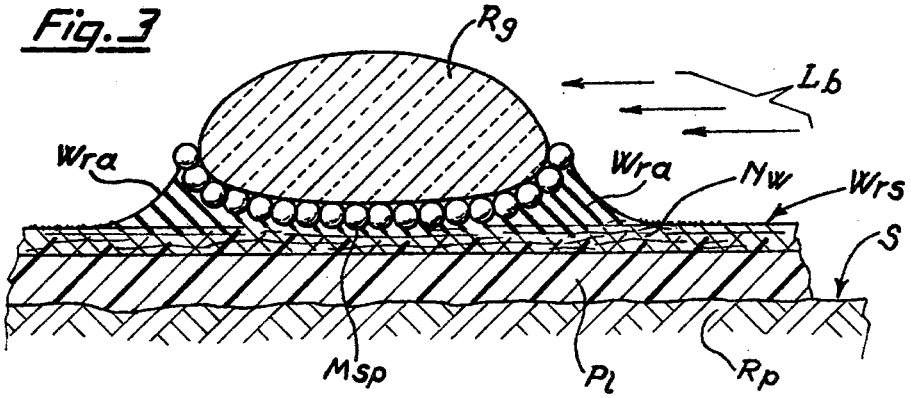
FIG. 3 illustrates in large scale the detail indicated at III in FIG. 2.

Referring now to the drawing, a marking produced according to the invention upon a surface S of a generally bitumen containing roadway area pavement Rp comprises an outer traffic wear resistant layer Wr+Mk.

The outer face Wrs of this layer has protruding hard particles Wr embedded in a composition Mk of the marking forming material.

The preferred composition is disclosed in my above indicated U.S. Pat. No. 4,069,291. Preferably, the thickness of said layer Wr+Mk is not greater than half millimeter. Further, this layer is advantageously provided with a fiber reinforced base layer Nw including a non-woven texture (FIG. 1) of fiberglass or of other very high tension resistant fibers.

The above-mentioned layers together form a tape material adapted to be laid on and intimately secured to a primer layer Pl formed of the pavement surface S. The fiber reinforced base layer may be impregnated by the wear resistant resin.

The marking further comprises suitably spaced night-time visibility ensuring retro-collimating globule Rg which has been described in my U.S. Pat. No. 4,071,384. The process of forming of the non-skidding surface of the marking has been described in my U.S. Pat. No. 3,953,365 and more particularly in my U.S. Pat. No. 4,020,211.

The phenomena concerned with the retro-reflection of light impinging at an angle very near to horizontal, say to the general roadway surface plane (the so called "grazing" light) have been widely discussed in my U.S. Pat. Nos. 3,935,365 and 3,964,821. It is evident that the best optical response is provided by rather large globules which relevantly protuberate above the marked surface.

Preferably, the retro-reflective globules are of asymmetrical configuration such as that taught in my U.S. Pat. No. 4,072,403. Advantageously, such globules are elongated in the direction of the prevailing impinging light Lb, that is are asymmetrical also in the vertical plane which contains such light.

The traffic regulating marking in accordance with the present invention is formed in the following manner.

First, the main part of the marking is formed, that is the primer layer Pl is laid on and secured to the pavement surface S. Then, the prefabricated tape material including the layers Wr+Mk and Nw is applied onto the primer layer Pl. Then, the globules $R_g$ are wetted by the wetting resin and applied, with layers of the wetting resin, onto the outer face Wrs of the layer Wr+Mk. The wetting resin forms a plurality of collars Wra, each located near one of the globules Rg. The collars Wra firmly connect the globules Rg to the layer Wr+Mk.

The wetted globules Rg are advantageously applied onto the above-mentioned layer Wr+Mk when the latter is still not hardened. Small beads Msp may coat a lower surface of each globule Rg. The wetting resin which is utilized for wetting of globules may be identical to the pigmented resin which forms the traffic wear resistant layer, and differ from the latter only by a higher degree of catalization.

It will be understood that each of the elements described above, or two or more together, may also find a useful application in other types of constructions differing from the types described above.

While the invention has been illustrated and described as embodied in a roadway area and a method of forming surface markings, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method of forming a traffic regulating marking on a roadway area, comprising the steps of forming a traffic wear resistant later on a surface of a roadway area, which layer has a predetermined thickness and is constituted by a pigmented resin material, said traffic wear resistant layer having an outer face; providing a plurality of retroreflective globules having a minimum dimension which is a multiple of the thickness of said traffic wear resistant layer and an elongated major dimension; wetting said globules by a wetting resin material which is compatible with said pigmented resin material of said traffic wear resistant layer; and applying the globules which are wetted by said wetting resin material, onto said outer face of said traffic wear resistant layer, so that the elongated major dimensions of said globules wetted by said wetting resins are in contact with but not embedded in said outer face of said traffic wear resistant layer, and said wetting resin material forms, on said outer face in the region of each of said globules, a separate collar which individually connects each globule to said outer face of said traffic wear resistant layer.

2. The method of claim 1, wherein the thickness of said traffic wear resistant layer is not greater than one half millimeter.

3. The method of claim 1, wherein the minimum dimension of said globules is greater than one millimeter.

4. The method of claim 1, wherein said globules are asymmetrical in a vertical sectional plane.

5. The method of claim 4, wherein said globules are elongated in the direction of light impingement.

6. The method of claim 1, wherein said wetting resin is identical to said pigmented resin material and is differentiated therefrom by a higher degree of catalyzation.

7. The method of claim 1; and further comprising the steps of providing a fiber reinforced base layer, said forming step including placing said traffic wear resistant layer onto said base layer so as to form a prefabricated tape material and applying said prefabricated tape material onto the surface of the roadway area.

8. The method of claim 1, wherein the said traffic wear resisting layer is a fiber reinforced base layer which is impregnated with a wear resistant resin.

9. The method of claim 1, wherein said pigmented resin material is hardenable, said globules wetted by said wetting resin being applied onto said traffic wear resistant layer when said pigmented resin material of said layer is not hardened.

10. A roadway area, comprising a pavement forming an area surface; and a traffic regulating marking including a traffic wear resistant layer secured to said surface and having an outer face, said traffic wear resistant layer having a predetermined thickness and being constituted by a hardenable pigmented material, a plurality of retroreflective globules contacting and upwardly protruding from said outer face of said traffic wear resistant layer, said retroreflective globules having a minimum dimension which is a multiple of the thickness of said traffic wear resistant layer and an elongated major dimension, said retroreflective globules being applied on said outer face of said traffic wear resistant layer so that the elongated dimension of said retroreflective globules are in contact with but not embedded in said outer face of said traffic wear resistant layer, and a wetting resin material which wets said globules before applying onto said outer face of said traffic wear resistant layer and forms a plurality of separate collars each extending upwardly from said outer face of said traffic wear resistant layer and individually connecting a respective one of said globules with said outer face of said traffic wear resistant layer.

11. The roadway area of claim 10, wherein the thickness of said traffic wear resistant layer is not greater than one half millimeter.

12. The roadway area of claim 10, wherein said retroreflecting globules protrude at a height greater than one millimeter.

13. The roadway area of claim 1, wherein said retroreflecting globules are asymmetrical.

14. The roadway area of claim 1, wherein said globules are elongated in the direction of light impingement.

15. The roadway area of claim 10, wherein said traffic wear resistant layer is formed by a fiber reinforced tape material.

16. The roadway area of claim 15, wherein said fiber reinforced tape material is impregnated with a wear resistant resin.

* * * * *